US007104013B1

(12) United States Patent
Gates et al.

(10) Patent No.: US 7,104,013 B1
(45) Date of Patent: Sep. 12, 2006

(54) SNAP-IN FACIA BORDER

(76) Inventors: J. Larry Gates, 1905 Old Batten Rd., Selma, NC (US) 27576; Ronald J. Wilkins, 1729 Old Batten Rd., Selma, NC (US) 27576

( * ) Notice: Subject to any disclaimer, the term of this patent is extended or adjusted under 35 U.S.C. 154(b) by 0 days.

(21) Appl. No.: 10/640,236

(22) Filed: Aug. 13, 2003

Related U.S. Application Data

(63) Continuation-in-part of application No. 10/198,835, filed on Jul. 22, 2002, now Pat. No. 6,751,911.

(51) Int. Cl.
*E04D 13/15* (2006.01)

(52) U.S. Cl. ..... 52/96; 52/60; 52/97

(58) Field of Classification Search ..... 52/94, 52/96, 97, 60, 62, 58, 302.6
See application file for complete search history.

(56) References Cited

U.S. PATENT DOCUMENTS

| | | | | | |
|---|---|---|---|---|---|
| 3,332,180 | A * | 7/1967 | Price | 52/94 |
| 3,344,566 | A * | 10/1967 | Miles et al. | 52/94 |
| 3,404,495 | A * | 10/1968 | Simpson, Jr. | 52/58 |
| 3,571,992 | A * | 3/1971 | Comiskey | 52/60 |
| 3,668,811 | A * | 6/1972 | Pollard | 52/94 |
| 3,738,068 | A * | 6/1973 | Attaway | 52/60 |
| 4,037,372 | A * | 7/1977 | Patry | 52/96 |
| 4,109,428 | A * | 8/1978 | Aarons | 52/94 |
| 4,320,605 | A * | 3/1982 | Carlson et al. | 52/94 |
| 4,404,777 | A * | 9/1983 | Lolley et al. | 52/60 |
| 4,439,956 | A * | 4/1984 | House | 52/60 |
| 4,461,128 | A * | 7/1984 | Knoebl | 52/94 |
| 4,483,112 | A * | 11/1984 | Rueblinger | 52/94 |
| 4,549,377 | A * | 10/1985 | Castle | 52/94 |
| 4,594,820 | A * | 6/1986 | Render | 52/60 |
| 4,648,218 | A * | 3/1987 | Butzen | 52/96 |
| 4,780,995 | A * | 11/1988 | Gittins | 52/60 |
| 4,780,997 | A * | 11/1988 | Taylor et al. | 52/96 |
| 4,798,033 | A * | 1/1989 | Weidl | 52/94 |
| 4,800,689 | A * | 1/1989 | Lane | 52/60 |
| 4,848,045 | A * | 7/1989 | Nichols et al. | 52/60 |
| 4,969,250 | A * | 11/1990 | Hickman et al. | 29/521 |
| 5,189,853 | A * | 3/1993 | Braine et al. | 52/96 |
| 5,252,411 | A * | 10/1993 | Yokokawa et al. | 429/62 |
| 5,414,965 | A * | 5/1995 | Kelley et al. | 52/60 |
| 5,619,827 | A * | 4/1997 | Church | 52/60 |
| 5,706,611 | A * | 1/1998 | Attaway et al. | 52/60 |
| 5,711,117 | A * | 1/1998 | Zaccagni et al. | 52/94 |
| 5,927,023 | A * | 7/1999 | Kittilstad | 52/60 |
| 6,272,797 | B1 * | 8/2001 | Finger | 52/94 |
| 6,578,322 | B1 * | 6/2003 | Kintop | 52/96 |
| 6,640,508 | B1 * | 11/2003 | Lindgren et al. | 52/200 |
| 6,751,911 | B1 * | 6/2004 | Gates et al. | 52/96 |
| 6,845,590 | B1 * | 1/2005 | Mills, Jr. | 52/60 |
| 6,912,814 | B1 * | 7/2005 | Inzeo et al. | 52/60 |
| 6,922,951 | B1 * | 8/2005 | Inzeo et al. | 52/94 |

* cited by examiner

*Primary Examiner*—Patricia L. Engle
*Assistant Examiner*—Gay Ann Spahn
(74) *Attorney, Agent, or Firm*—Mills Law Firm PLLC

(57) ABSTRACT

A facia border for covering the periphery of a structure between the roof and a soffit includes mounting clips attached at periodic peripheral locations for slidably attaching facia trim at detented positions.

2 Claims, 14 Drawing Sheets

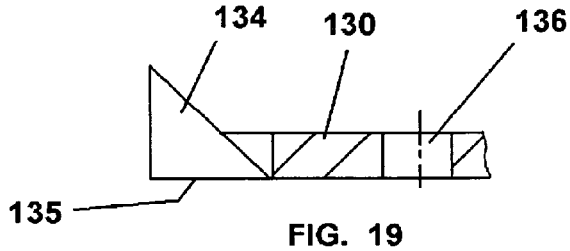
FIG. 19
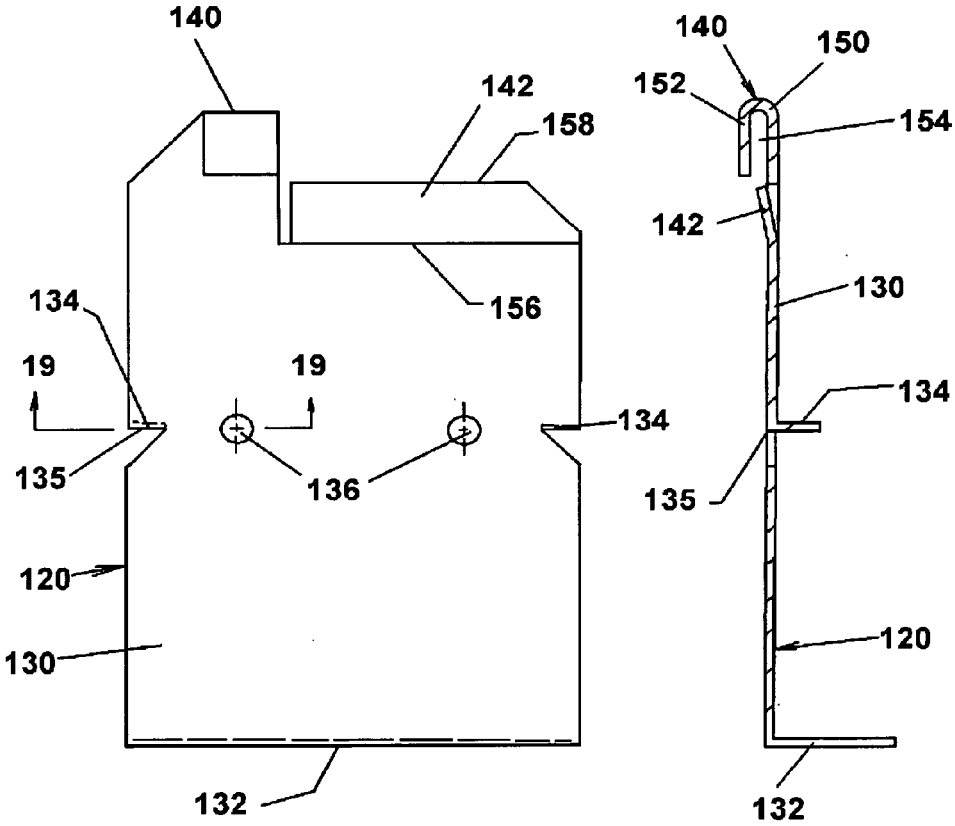
FIG. 18
FIG. 17

SNAP-IN FACIA BORDER

RELATED APPLICATION

This is a continuation-in-part application of U.S. patent application Ser. No. 10/198,835 filed on Jul. 22, 2002 in the name of Gates, J. Larry et al. and entitled "Facia Border", now U.S. Pat. No. 6,751,911, issued on Jun. 22, 2004.

FIELD OF THE INVENTION

The present invention relates to facia borders for use around the periphery of a building roof, and, in particular, to a two-piece facia system for easy and accurate installation between the roof and soffits.

BACKGROUND OF THE INVENTION

Facia borders are commonly used between outer walls and roofs to provide a structural and architectural transition. Where a transition is between a soffit and the roof, an elongate strip or board is attached to the nailing plate on the outer wall and overlies the upper end thereof. A molding strip is oftentimes used to provide the final transition with the roof.

The installation using lumber is well established. The material is relatively rigid and presents few problems in alignment or fastening. The advent of light weight pre-finished materials, such as aluminum trim strips, however, present installation, quality control, and decorative problems. The trim strips are commonly roll-formed on site from coiled stock, cut to convenient extended lengths, and nailed at the upper ends to the underlying nailing plate. Because of the thin wall material commonly used, 20 gauge or less in thickness, the formed strips are prone to deflection and sagging during installation, presenting an undesirable waviness at the bottom detracting from appearance. Unless carefully handled, the strips may also kink or buckle, further complicating installation and appearance. Thus, unless painstakingly matched to reference markings requiring advanced carpentry skills, the finished border is irregular and decoratively compromised.

Further, the fastener installation tends to impart localized surface blemishes, in the form of dimples and waves, which are likewise unattractive. Moreover, the rigid attachment of the trim strip presents thermal expansion problems that can produce bowings and other thermally related distortions of the trim strip. Not entirely satisfactory attempts have been made to overcome the attachment difficulties using adhesives, however, durability and long-term adherence problems persist.

Facia systems have been proposed using custom components, in both aluminum and vinyl stock. For instance, U.S. Pat. No. 6,272,797 to Finger discloses a rake board installation wherein upper and lower J-channels capture inwardly projecting hooks at the top and bottom of a trim piece. A similar custom retention system is disclosed in U.S. Pat. No. 4,461,128 to Knoebl wherein upper and lower mounting channels capture the facia panel. Another mounting system is disclosed in U.S. Pat. No. 3,332,180 to Price wherein spaced mounting clips engage the lower flange of a trim member, with the upper end of the trim member nailed to the roof sheeting. While each of the foregoing eliminates some of the drawbacks of current facia installation, custom and accordingly expensive components are required.

SUMMARY OF THE INVENTION

The present invention provides a snap-in facia border utilizing conventional roll formed coil trim. The facia trim is attached to mounting clips periodically spaced along the roof periphery. The mounting clips include horizontal barbs that are temporarily tacked on the nail plate along a chalk line that insures uniform positioning of the trim relative to the roof line, soffit and wall facing. After alignment, the clips are attached to the nailing plate with conventional fasteners. The upper end of the clip and an overlying leg of the roof drip edge form a pocket for receiving and retaining the upper end of the trim. The clip includes a lower leg that is slidably received in the lower trim flange for retaining the bottom of the trim. The upper end of the trim is provided with rearward swaged indentations that detent over a locating ledge on the top of the clip for limiting downward movement and locking the trim in place. The trim may be conveniently slid into the locked condition whereat the indentations detent with the locating ledge of the mounting clips, easily and with minimal dexterity. Resultantly, an accurately aligned trim using desirable standard trim components is provided.

Accordingly, it is an object of the present invention to provide a facia system for roof borders that is easy to install using conventional trim facing.

Another object of the invention is to provide a simplified method for accurately installing coil trim.

A further object of the invention is to provide a two-piece facia border for a roof periphery that is easily, accurately and securely assembled without visible fasteners.

DESCRIPTION OF THE DRAWINGS

The above and other objects and advantages of the present invention will become apparent upon reading the following detailed description taken in conjunction with the accompanying drawings in which:

FIG. 17 is a front view of the mounting clip for the facia border shown in FIG. 15;

FIG. 18 is a side view of the clip shown in FIG. 17;

FIG. 19 is an enlarged fragmentary cross sectional view taken along line 19—19 of the clip of FIG. 17 illustrating the locating barbs;

DETAILED DESCRIPTION OF THE PREFERRED EMBODIMENTS

Figure 1:
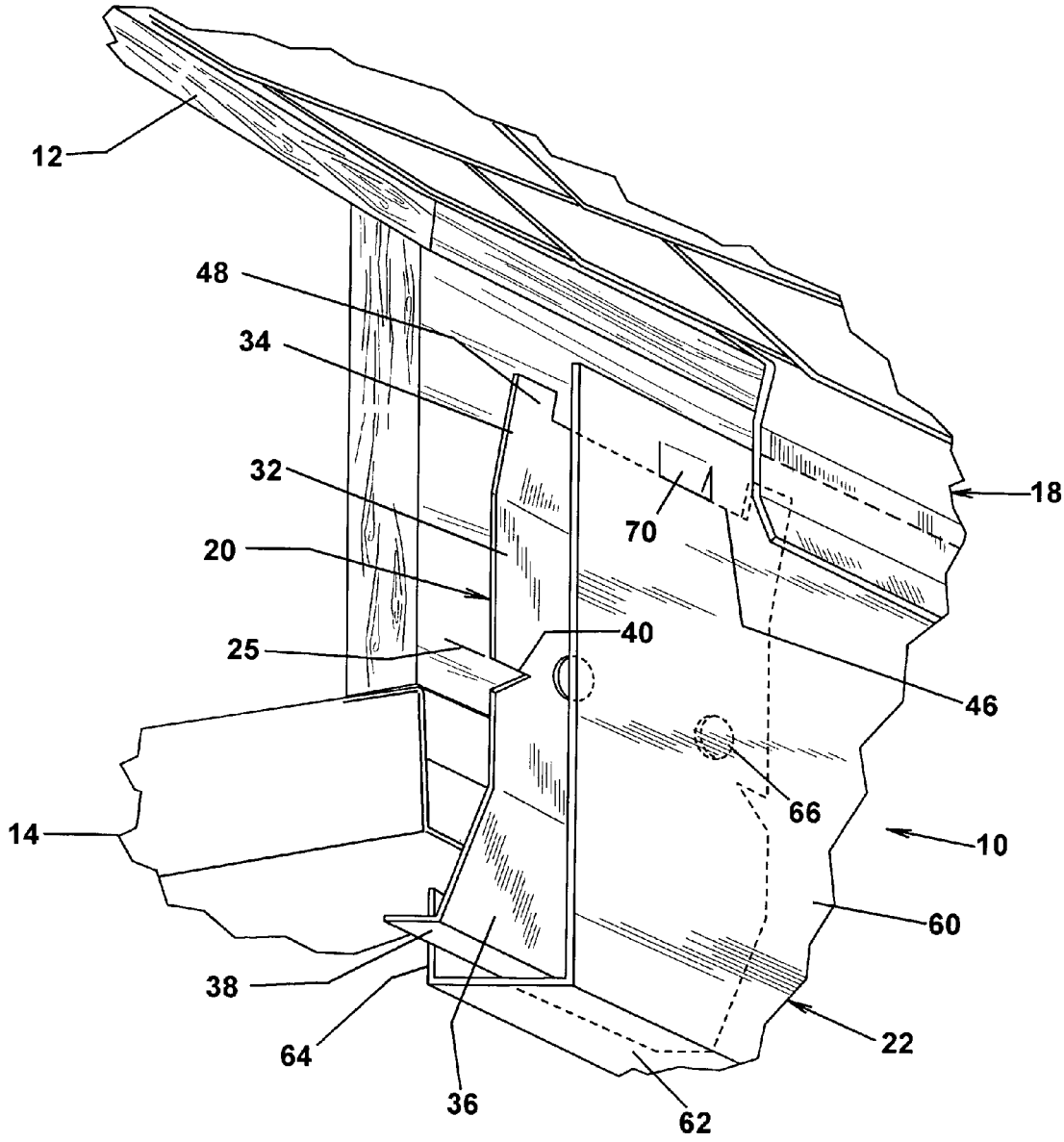
FIG. 1 is a side cross sectional perspective view of a facia border in accordance with a preferred embodiment of the invention.
Figure 2:
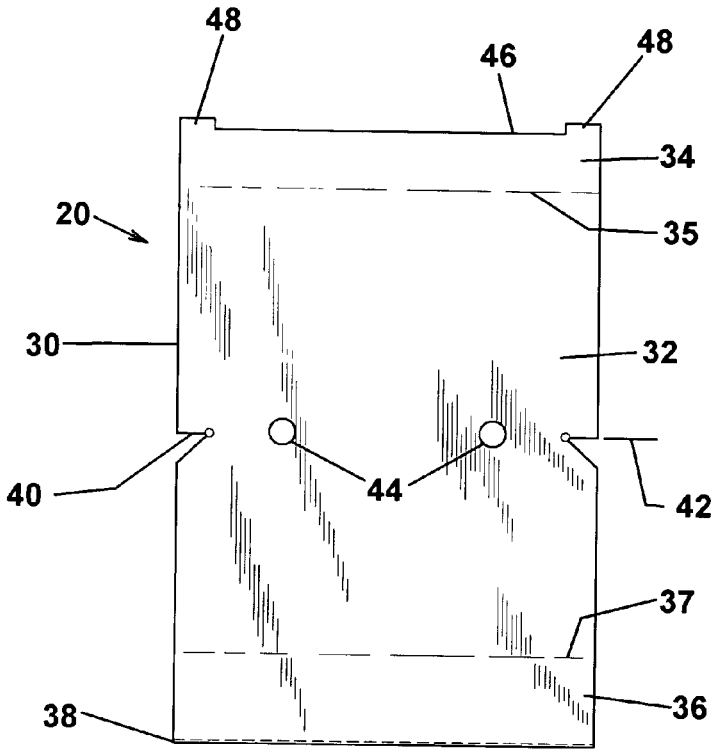
FIG. 2 is a front view of the mounting clip for the facia border of FIG. 1.

Referring to the drawings for the purpose of describing the preferred embodiment and not for limiting same, FIGS. 1 and 2 illustrate a facia border 10 disposed about the periphery of a structure between a roof 12 and a soffit 14. The border may also be applied as a transition with a wall. In final assembly, the top end of the facia border 10 is commonly overlaid by a drip edge 18 or a corner molding as in other embodiments as described below. As a result, the facia border 10 forms a decorative facing for the transitions between structure walls and roofing. The facia border 10 may be used for horizontal and pitched runs.

The facia border 10 comprises a plurality of mounting clips 20 to which an elongated fascia trim 22 is slidably secured. As described in greater detail below, the clips 20 are periodically attached to a nailing plate or fascia board 24, customarily 16 inch to 24 inch on-center spacings, and longitudinally aligned with respect to a reference line 25 positioned a predetermined distance above the bottom of the board. The facia board 24 is typically dimensional lumber, 2×4, 2×6, 2×8, 2×10 or larger.

Figure 3:
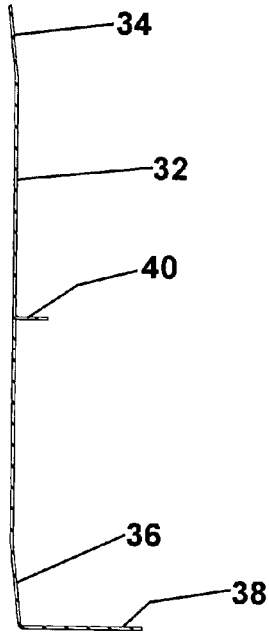
FIG. 3 is a side view of the clip of FIG. 2.
Figure 4:
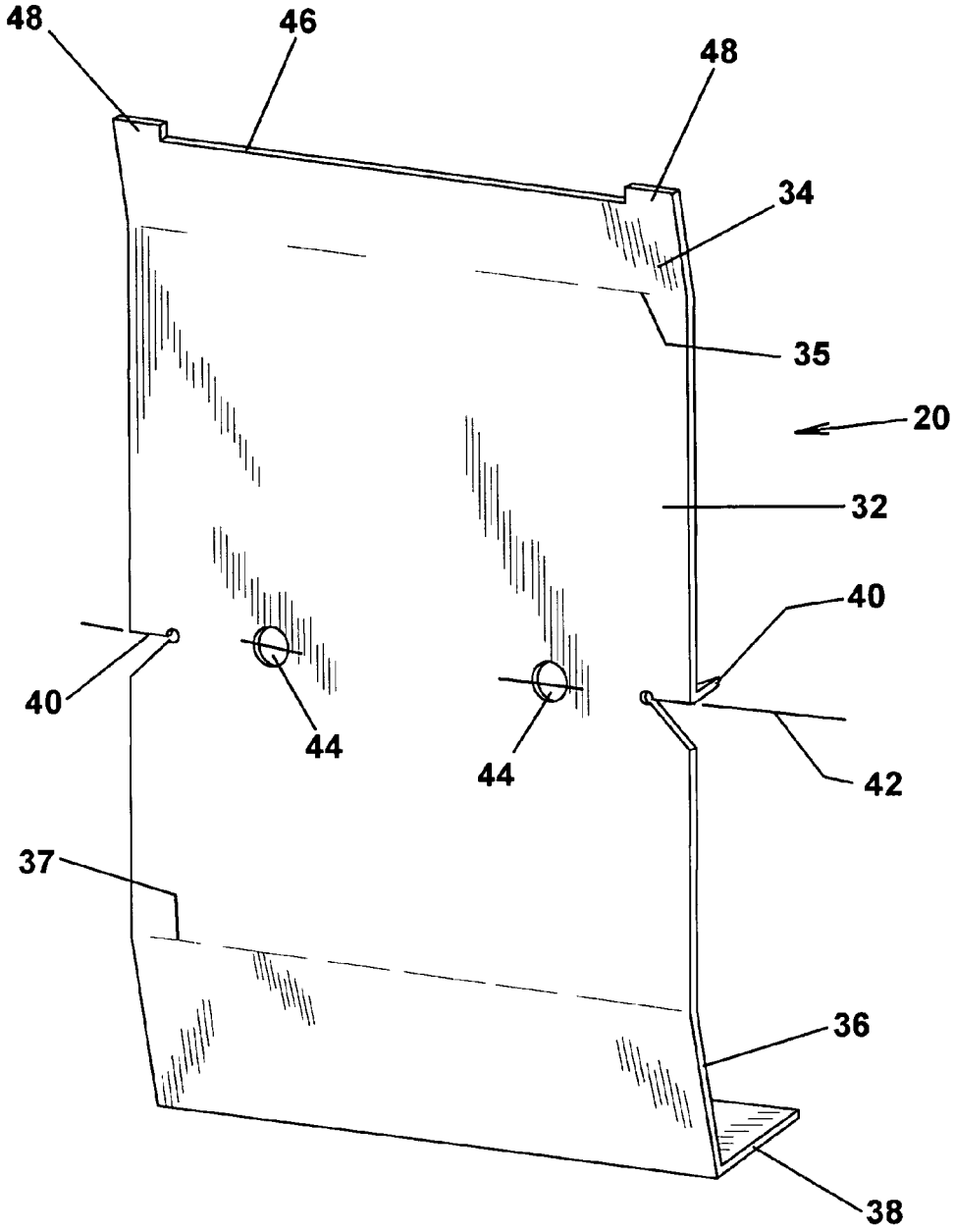
FIG. 4 is a perspective view of the clip of FIG. 2.

Referring to FIGS. 2 through 4, the mounting clip 20 comprises a unitary generally rectangular body having laterally spaced vertical sidewalls and vertically spaced horizontal end walls. The clip 20 is stamped from sheet material. A galvanized sheet of about 0.020 inch thickness is preferred. The mounting clip 20 includes a vertical front wall 30 having a center panel 32, an upper leg 34 and a lower leg 36. The upper leg 34 is forwardly and upwardly inclined at a shallow angle with respect to the center panel 32 about an upper horizontal fold line 35. The lower leg 36 is rearwardly and downwardly inclined at a shallow angle with respect to the center panel 32 about a lower horizontal fold line 37. The lower leg 36 includes a rearwardly turned horizontal lower wall 38.

A triangular, a reversely bent barb 40 is formed in horizontal alignment at each lateral side of the center panel 32. The barb 40 is triangular and projects rearwardly normal to the center panel 32. The barbs 40 are horizontally aligned along a horizontal reference line 42. A pair of circular nailing holes 44 is formed in the center panel 32 inwardly of and with axes horizontally aligned at line 42 with the barbs 40.

The upper leg 34 terminates upwardly with a U-shaped notch or pocket defined by a base or stop ledge 46 and laterally spaced stop tabs 48. The base 46, because of the inclination of the upper leg 34 is spaced forwardly of the nailing board 24 sufficiently for locking with the trim 22, as described in greater detail below. The upper leg 34 and lower leg 36 are inclined between 0° and 20° and preferably between 5° and 15°, with good retention being provided with an inclination of about 6° to 10°. The lower leg 36 including the lower wall 38 has an overall transverse width for establishing a sliding fit with the base of the trim 22 as described below.

Referring to FIGS. 1 and 5 through 7, the facia trim 22 is an elongate member brake formed to desired lengths, or roll formed from coiled strip on-site to working lengths and horizontal cross section detail. The trim 22 has a generally L-shaped side profile comprising a front wall 60 having a rearwardly extending bottom wall 62 terminating with a reversely upwardly turned lip 64. The inner surfaces of the front wall 60, the bottom wall 62 and the lip 64 define an upwardly opening slot 65 having a width for slidably receiving as illustrated the lower leg 36 of the mounting clip 20.

The front wall 60 may be formed of varying conventional configurations, profiles and textures for architectural preferences. In the present invention, the front wall 60 includes horizontally spaced, rearwardly projecting locating indents or crimp tabs 70 at the upper end thereof. The crimp tabs 70 are arranged in pairs that are longitudinally spaced along the length of the facia board 24 corresponding to the spacing of the mounting clips 20. A single tab 70 may be alternatively employed, however, the redundancy of plural tabs is preferred.

If arranged in the illustrated pairs, the spacing of the tabs 70 is less than the length of the ledge 46 thereby allowing for flexible longitudinal alignment and relative movement under thermal expansions and contractions. In assembly, the stop tabs 48 limit horizontal movement of the trim 22 to the length of the ledge 46.

Figure 10:
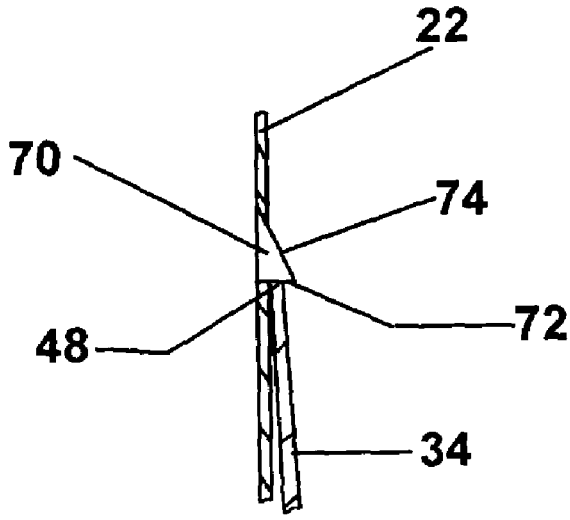
FIG. 10 is a fragmentary cross sectional view of the crimp tabs on the facia trim engaging the locating ledge of the mounting clip.
Figure 11:
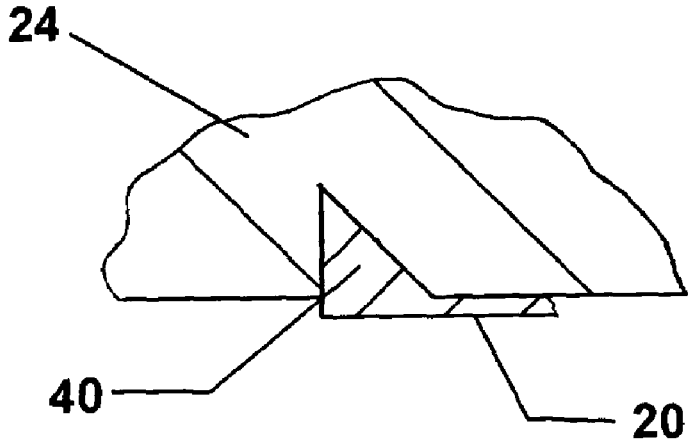
FIG. 11 is a fragmentary cross sectional view of the mounting clip barbs in place on the facia board.

The crimp tabs 70 may be formed by a suitable metal-working crimping device, such as a commercially available SNAP-LOC or MALCO SL-1 crimpers. As shown in FIG. 10, each tab 70 is generally defined by a severed lower horizontal peripheral edge 72, which is rearwardly spaced from the front wall by a rearwardly swaged inclined transition wall 74. Accordingly, the edge 72 forms a rearwardly indented horizontal surface that engages the ledge 48 on the clip 20. In assembly, the tabs 70 are adjacent the top edge of the trim 22 and covered by the lower leg of the drip edge 18. Establishing the tabs 70 at the full depth of the crimping tool places the edge 72 about ¼ to ⅜ inch below the top edge.

Referring again to FIGS. 1 and 2, for representative installation on a 2×6 facia board, a facia strip has a height of around 6⅞ inches, and a 1 inch base with a ¾ inch return leg. The tabs 40 are located at full depth for the crimping tool, about ⅜ inch below the top edge. The soffit has a thickness of about ¾ inch. The clip 20 has a width of 3 inches and a height of 4½ inches, with the barbs 2¼ inches above the bottom of the clip. The locating ledge is about 1/16 inch below the top surface.

Figure 8:
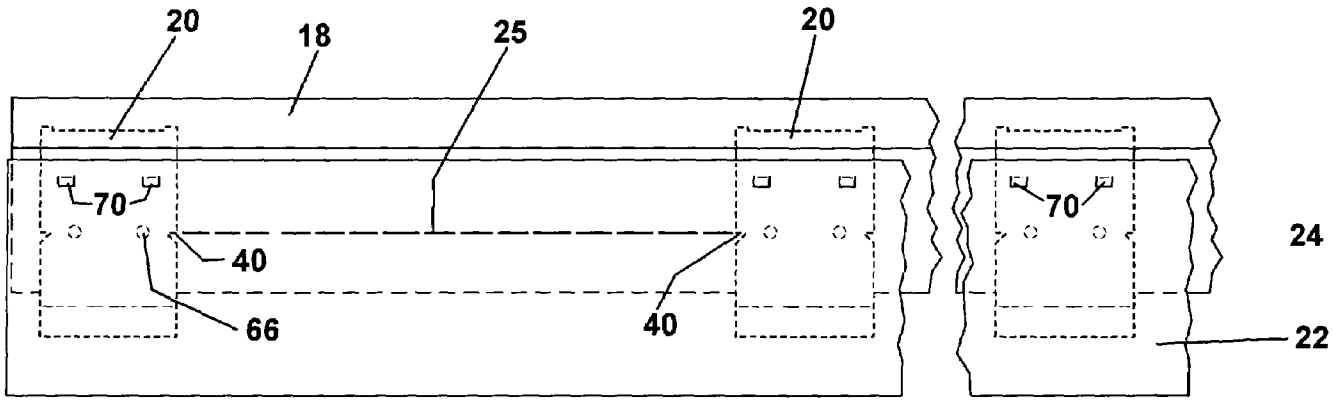
FIG. 8 is a side view showing the layout and spacing of the mounting clips and the facia trim moved toward the mounting position.
Figure 9:
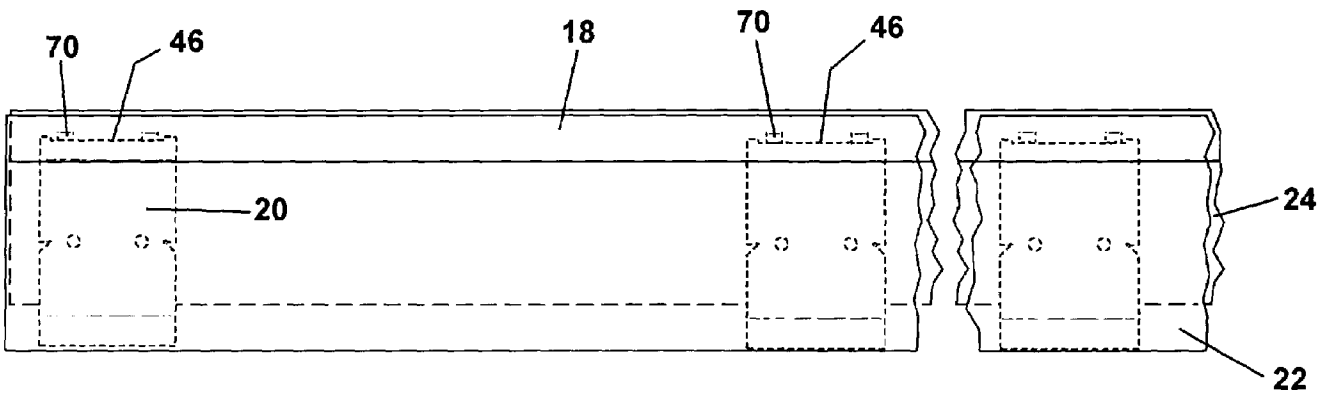
FIG. 9 is a side elevational view of the facia border with the fascia trim attached at the mounting clips.

Referring to FIG. 8, the barbs 40 are aligned with line 25 and clips 20 tacked in place 1 inch above the bottom surface of the fascia board 24 and nailed in place by fasteners 66. As shown in FIG. 9, when the top of the strip 22 located within the slot between the board 24 and the drip edge, the tabs 70 engage the ledge 46 with the tabs 70 hidden from view by the drip edge, resulting in a nail-free appearance.

Figure 5:
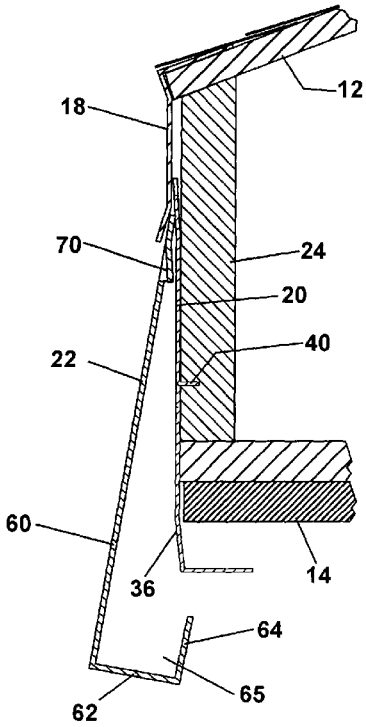
FIG. 5 is a cross sectional view of the clip installed with the facia trim inserted at the drip edge.
Figure 6:
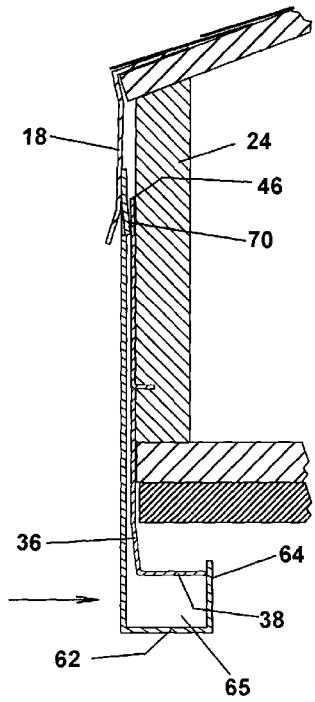
FIG. 6 is a view similar to FIG. 6 showing the facia trim further inserted between the drip cap and the facia board at the mounting position.
Figure 7:
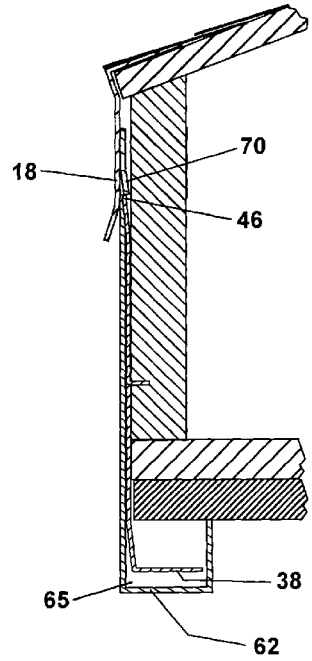
FIG. 7 is a view similar to FIG. 6 showing the facia trim in the mounting position on the mounting clip.

The border is assembled by initially inserting the top end of the strip 22 in the downwardly opening slot between the facia board 24 and the outwardly flexed lower leg of the drip edge 18, as shown in FIG. 5. As the strip 22 is raised further as shown in FIG. 6 the lower end of the strip is flexed inwardly to receive the lower leg 36 of the clip. The strip is further raised until the tabs 70 snap over the ledge 46 and the lower leg 36 is positioned in the facia slot with the return leg 68 engaging the soffit 14.

In assembly, outward movement of the top of the facia is limited by the flexible lower leg of the drip edge 18. Outward movement of the bottom of the facia is limited by the lower leg 36 in the slot. Downward movement of the facia is limited by the tabs 70 and locating ledge. Upward movement is limited by the drip edge. Thermal expansion and contraction is accommodated by the locating ledge and limited by the stop 48.

The facia border 10 as described above may be readily and accurately assembled around the roof perimeter. Initially, as shown in FIG. 8, a chalk line 25 is established a predetermined distance above the lower edge of the nailing plate 24, preferably the 1 inch measurement discussed above. The barbs 40 of the mounting clips 20 are located at desired periodic spacings along the line 25. The barbs are tacked into place at the line 90. The fasteners 66, such as nails or screws, are installed through the clip holes to fixedly secure the clips 20 to the facia board 24.

After installation of the clips 20, the strip 22 is preliminary horizontally positioned on the clips with the tabs 70 aligned with the locating ledge 48. As the trim strip 22 is further vertically raised, the upper end entering the slot between the drip edge 18 and board 24 slot, with the tabs 40 resiliently snapping over the ledge. Concurrently the lower end of the facia is flexed inwardly allowing the lower leg to telescope in the facia slot resulting in the assembled conditions shown in FIGS. 1 and 7. Thereat, the vertical positions are repetitively accurately maintained, and inward and outward movement restrained at the top end, by the upper drip edge pocket and at the lower end by the cooperation between the lower wall and the lower slot.

Figure 12:
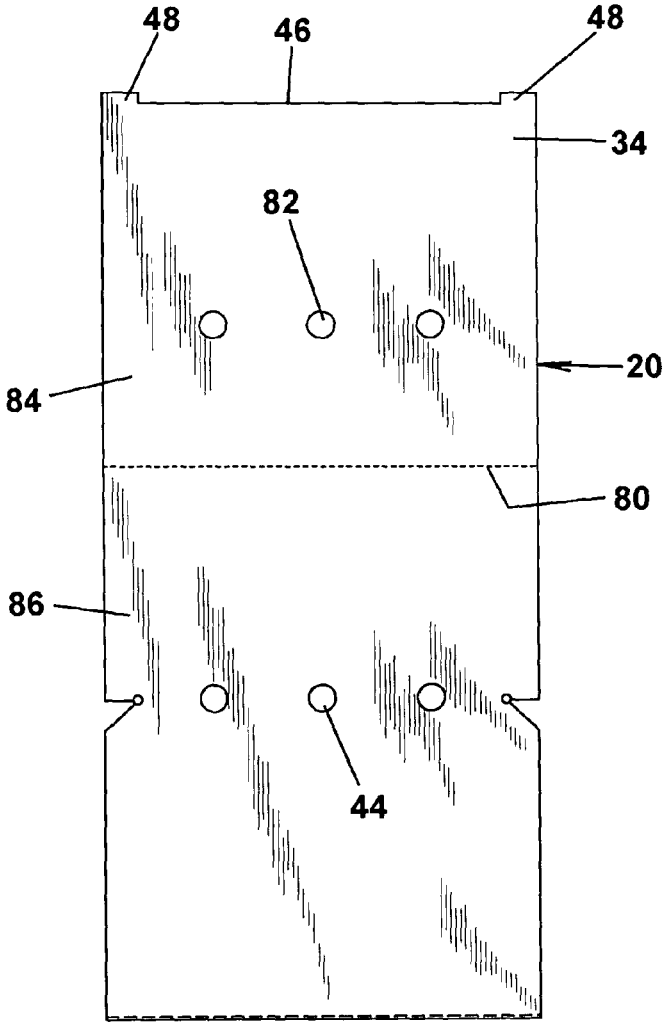
FIG. 12 is a front view of a mounting clip in accordance with another embodiment of the invention.
Figure 13:
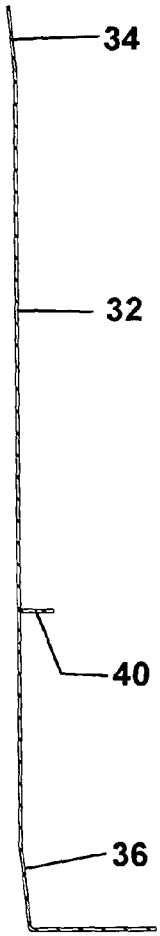
FIG. 13 is a side view of the mounting clip shown in FIG. 12.

Referring to FIGS. 12 and 13, there is shown a further embodiment of the mounting clip 20 for use in wider borders based on 2×6, 2×8, 2×10 or larger boards. Therein the upper leg 34 and lower leg 36 are similar to the previously described embodiment. The center section 32 is enlarged above the barbs 40 and includes a horizontal score line 80 and a second set of nailing holes 82. For 2×6 installations, the clip is installed as discussed above. For wider facia boards, the clip is snapped along the score line 80, providing separate upper and lower sections 84, 86.

Figure 14:
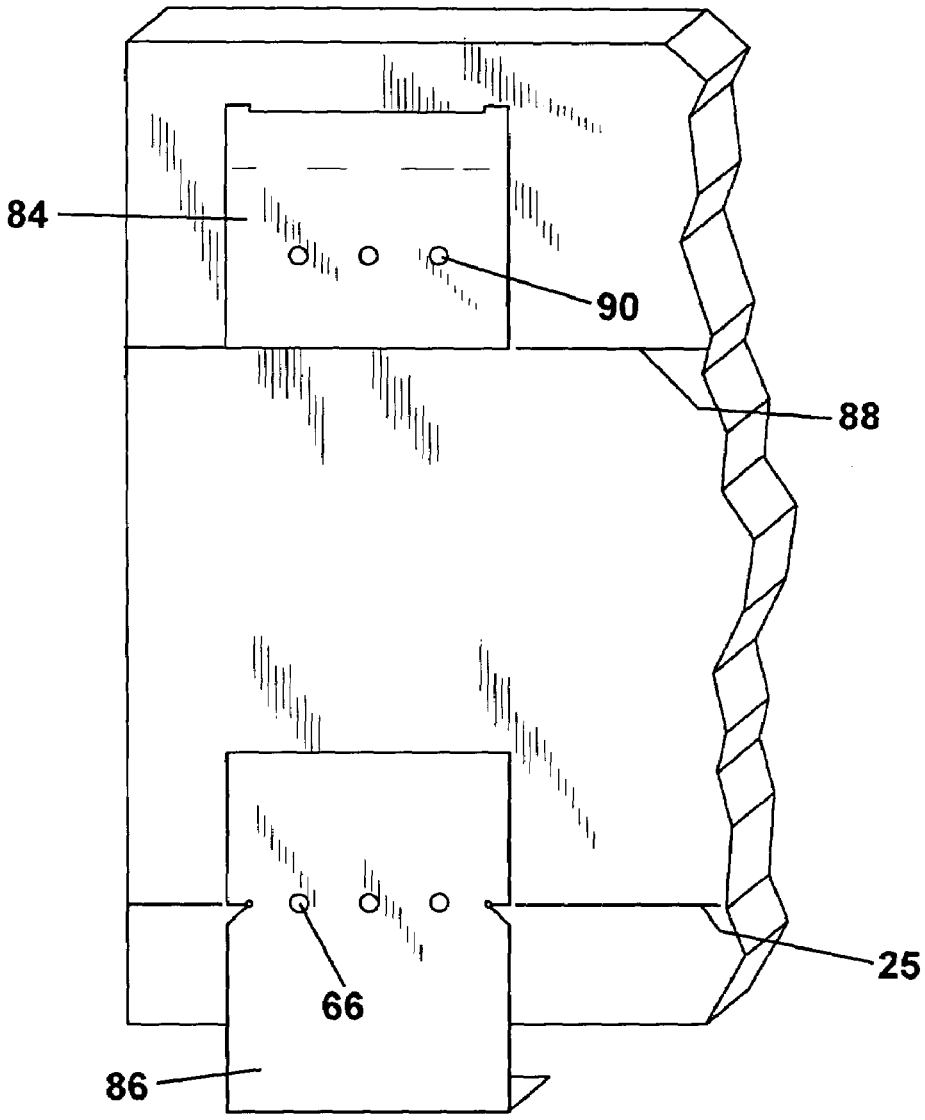
FIG. 14 is a fragmentary front perspective view of the mounting clip of FIGS. 12 and 13 in attached position on a mounting plate.

Referring to FIG. 14, for installation on a larger board, such as a 2×10, the lower section 86 is aligned to reference line 25, tacked at the barbs, and attached with fasteners 66. A second reference chalk line 88 is placed on the board. The upper section 84 is vertically centered over the lower section 86 with the score line 80 aligned with chalk line 88, and attached by fasteners 90. The fascia strip is then attached to the split clips as described above.

Figure 16:
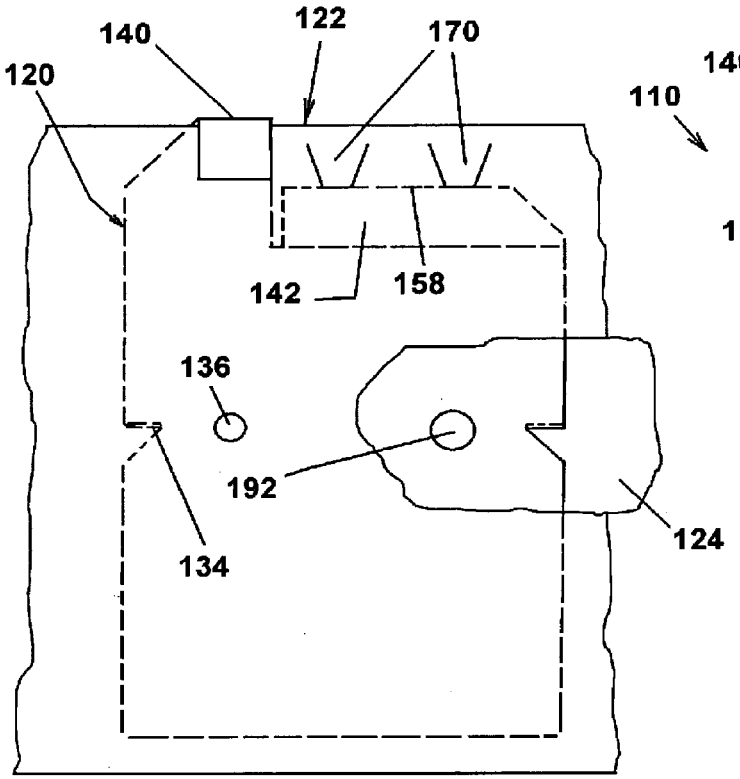
FIG. 16 is a fragmentary front view of the facia border shown in FIG. 15.
Figure 15:
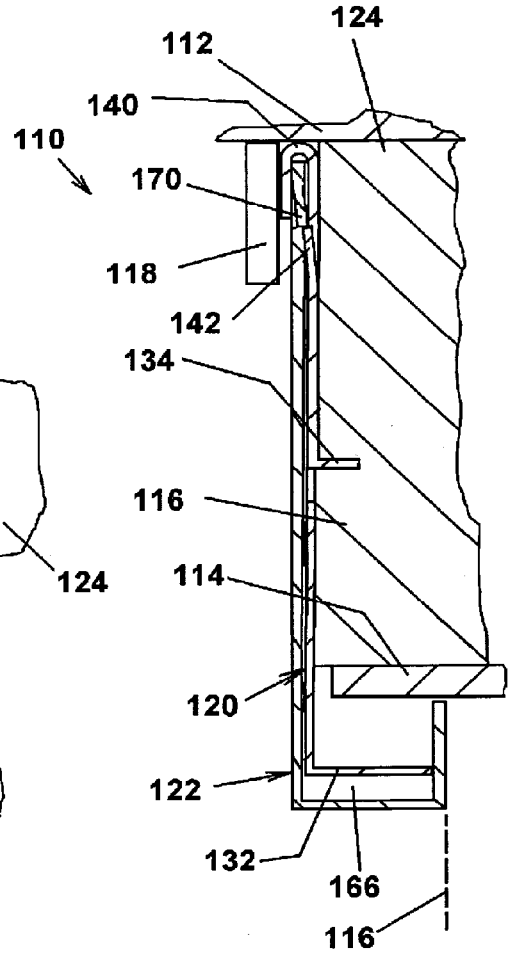
FIG. 15 is a side cross sectional view of a facia border in accordance with another embodiment of the invention.
Figure 21:
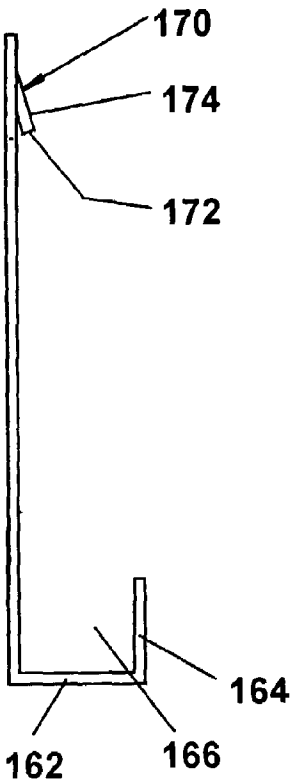
FIG. 21 is a side view of the facia trim shown in FIG. 20.
Figure 20:
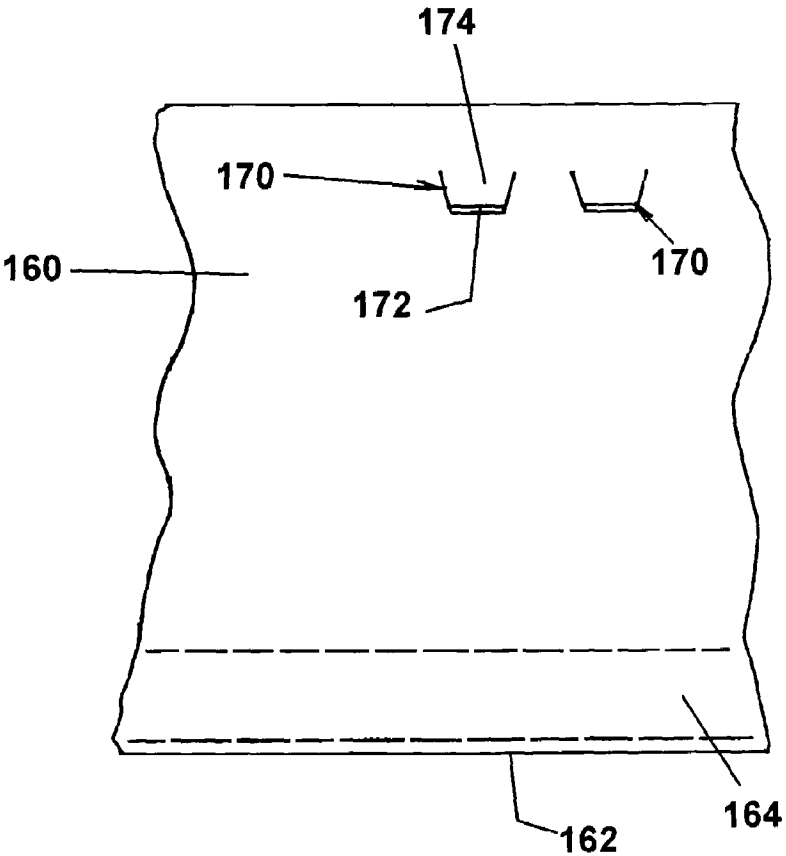
FIG. 20 is a fragmentary front view of the facia trim of the facia border shown in FIG. 15.

Referring to FIGS. 15 and 16 illustrating another embodiment of the invention, a facia border 110 is disposed about the periphery of a structure between a roof member 112 and a horizontal soffit 114, or wall facing 116, shown in dashed lines. In final assembly, the top end of the facia border 110 is commonly overlaid by corner molding 118, such as a drip edge interposed between the roof deck and shingles with a depending leg overlying the upper end of the border. As a result, the facia border 110 forms a decorative facing for the transitions between structure walls and roofing.

Figure 22:
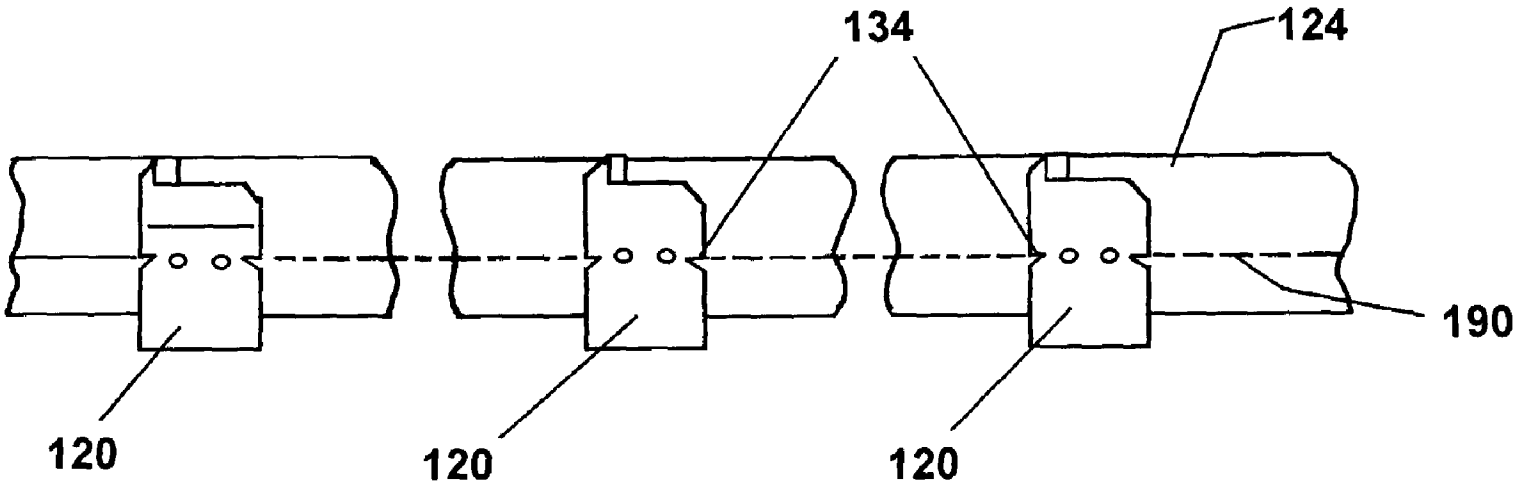
FIG. 22 is fragmentary front elevational view of the mounting clips installed on a fascia plate.

The facia border 110 comprises a plurality of mounting clips 120 to which an elongated strip of facia trim 122 is slidably secured. As shown in FIG. 22, the clips 120 are periodically attached to a nailing plate 124, customarily 16 inch to 24 inch on center spacings. The nailing plate 124 is typically dimensional lumber, 2×4 or 2×6.

Another embodiment of the border is shown in FIGS. 15 through 18. Therein, the mounting clip 120 comprises a unitary body formed of sheet material. The mounting clip 120 includes a vertical front wall 130 and a rearwardly turned lower horizontal wall 132 at the lower end thereof. A pair of triangular reversely bent barbs 134 is formed at the sides of the front wall 130 and project rearwardly orthogonal thereto. The barbs 134 are horizontally aligned along a horizontal fold line 135 and spaced in about the middle of the front wall 132. A pair of circular nailing holes 136 are formed in the front wall 130 inwardly of and with axes horizontally aligned with the barbs 134. The front wall 130 has parallel vertical sidewalls and terminates upwardly with a reversely bent clip pocket 140 and a forwardly inclined stop plate or tab 142 having an upper locating ledge. The upper corners of the front wall are provided with beveled surfaces. The pocket 140 and the locating tab 142 are horizontally separated by a vertical gap 146.

The pocket 140 is defined by a reversely bent, U-shaped rim 150 and a generally rectangular frontal wall 152, forwardly spaced from the front surface of the wall 130 to define a downwardly opening slot 154. The stop tab 142 is forwardly inclined about a horizontal fold line 156 presenting a top horizontal locating ledge 158. The stop plate 142 is inclined sufficiently for locking with the trim 122 as described in greater detail below. The stop plate is inclined between 0° and 20° and preferably between 5° and 15°, with good retention being provided with an inclination of about 10°. The lower wall 132 has a length for establishing a sliding fit with the trip strip as described below.

The trim 122 is a conventional elongate member formed in preformed lengths, or roll formed from coiled strip on-site to working lengths. The trim 122 has a L-shaped side profile comprising a front wall 160 having a rearwardly extending bottom wall 162 terminating with a reversely upwardly turned lip 164. The inner surfaces of the front wall 160, the bottom wall 162 and the lip 164 define an upwardly opening slot 166 having a width for slidably receiving the lower wall 132 of the mounting clip 120.

The front wall 160 may be formed of varying conventional configurations and textures for architectural preferences. In the present invention, the front wall 160 includes horizontally spaced, rearwardly projecting locating indents or tabs 170. The tabs 170 may be arranged in pairs that are longitudinally spaced along the length of the facia board corresponding to the spacing of the mounting clips 120. If arranged in the illustrated pairs, the spacing is less than the length of the inclined ledge 158. The tabs 170 may be formed by a suitable metalworking crimping device, such as a commercially available SNAP-LOC crimper. Each tab 170 is generally defined by a severed lower horizontal edge 172, which is rearwardly spaced from the front wall by a rearwardly swaged inclined transition wall 174. Accordingly, the locating edge 172 forms a rearwardly indented surface for engagement with the edge 158 of the mounting clip 120. The locating edge 172 is slightly less than the distance between the pocket 140 and the ledge of the mounting clip such that when the upper end of the facia trim is received in the pocket 154, the indent 170 engage the ledge 158 to vertically locate the trim with respect to the mounting clip. The distance between the indents 170 and the lower wall 162 is substantially the same or less than the distance between the ledge 158 to the lower wall 132 of the clip.

The facia border 110 as described above may be readily and accurately assembled around the roof perimeter. Initially, as shown in FIG. 22, a chalk line 190 is established a predetermined distance above the lower edge of the nailing plate, representing a distance whereat the lower end of the trim strip is preferably disposed. The barbs 134 of the mounting clips are located at desired periodic spacings along the line 190. The barbs are tacked into place to align the clips. Suitable fasteners 192, such as nails or screws, are installed through the plate holes 136 to fixedly secure the clips 120 to the nailing plate 124.

Figure 23:
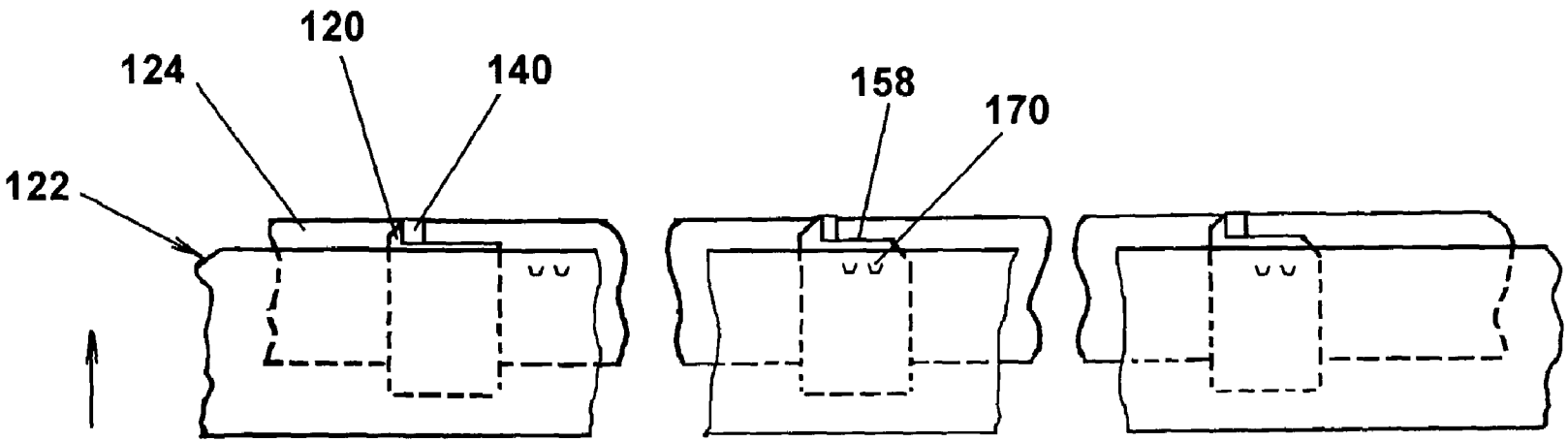
FIG. 23 is a view similar to FIG. 22 showing the facia plate on the clips prior to locking.

Referring to FIG. 23, after installation of the clips, the trim 122 is preliminary horizontally positioned on the clips with the indents aligned with the stop plate and the slot 164 aligned with the lower wall 132. The trim 122 is further vertically raised as indicated by the arrow with the upper end entering the clip pocket 140, the tabs 170 resiliently snapping over the lip, and the lower wall telescoping in the pocket resulting in the assembled conditions shown in FIGS. 15 and 16. Thereat, the vertical positions are repetitively accurately maintained, and inward and outward movement restrained at the top end, by the upper pocket and at the lower end by the cooperation between the lower wall and the lower slot.

Figure 24:
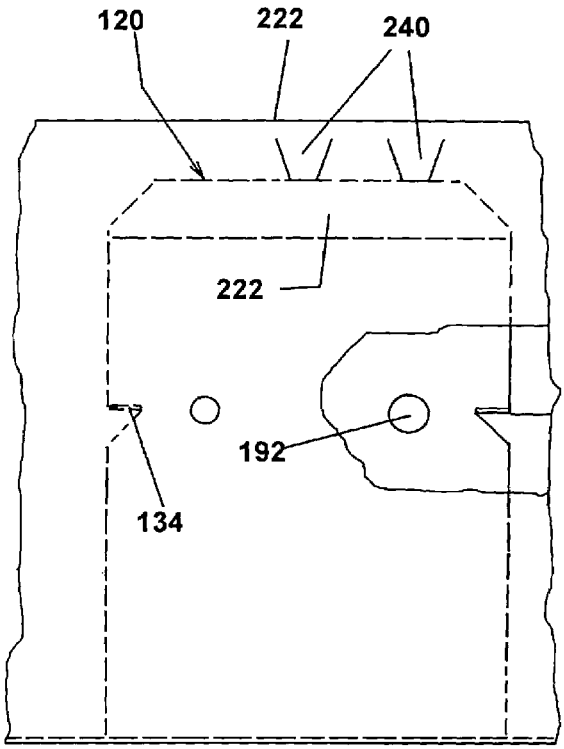
FIG. 24 is a side cross sectional view of a facia border in accordance with another embodiment of the invention.
Figure 25:
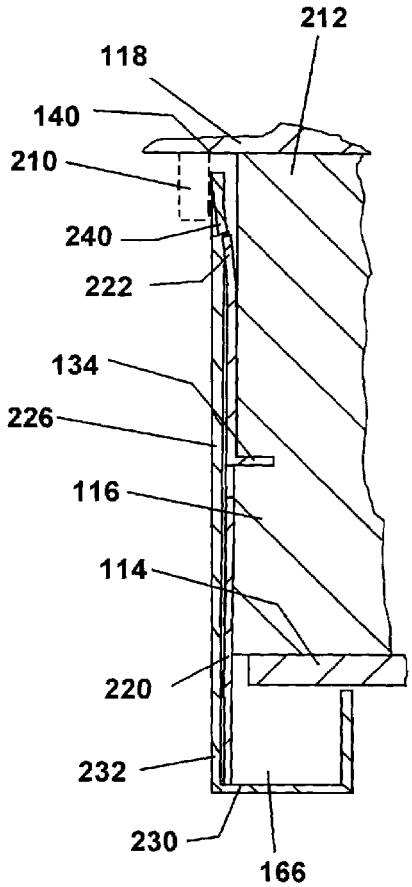
FIG. 25 is a fragmentary front view of the facia border shown in FIG. 24.

Another embodiment of the invention is shown in FIGS. 24 and 25 particularly adapted for installations wherein the facia corner molding 210 is installed to the nailing plate 212 prior to trim strip installation. Therein, the mounting clip 220 includes a top portion defined by a forwardly inclined tab 222 providing a horizontal locating surface 224 along the upper edge eliminating the top pocket of the above embodiment. The length of the front wall 226 is increased to provide direct contact with the lower wall 230 of the facia board 232. The clip 220 is installed similar to the above embodiment. For installation, the top end of the trim strip 232 is upwardly inserted between the corner molding 210 and the nailing 212 until the indents 240 snap over the edge of the stop plate 222 thereby establishing a locked position against downward movement. Vertical upward movement is restrained by engagement of the lower end 242 of the clip with lower flange of the trip strip. Inward and outward movement of the top of the trim strip is restrained by corner molding. If desired to restrain inward and outward movement of the bottom of the facia board, the clip 220 may be provided with a rearward lower leg for receipt in the lower slot of the facia board, similar to the first described embodiment.

It will thus be appreciated that the present invention provides a nail free mounting for roof facia board that can be easily and quickly installed to precise standards without requiring high skill levels. Once in place, the retention features establish secure retention while allowing thermal expansions and contractions without warping or wrinkling, and resist outer deflection occasioned by winds and precipitation.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed is:

1. A method of mounting a facia border on a peripheral surface of a structure adjacent the roof, comprising the steps of:

providing mounting clips having a plurality of laterally aligned barbs;

providing a first straight line on said peripheral surface;

aligning said barbs at spaced intervals along said first straight line;

embedding said barbs into said peripheral surface to preliminarily attach said mounting clips thereto;

fixedly attaching said mounting clips to said peripheral surface with mechanical fasteners at a mounting position;

providing forwardly and upwardly inclined upper ends on said mounting clips having horizontal locating edges;

providing rearwardly and downwardly inclined lower ends on said mounting clips that extend below said peripheral surface in said mounting position;

providing a trim member having a front wall overlying said mounting clips with an upper end located above said inclined upper ends of said mounting clips in said mounting position;

providing a rearwardly reversely turned member at a lower end of said trim member having an upwardly opening lower slot for receiving said inclined lower ends of said mounting clips at said mounting position;

providing rearwardly indented portions on said trim member for engaging said locating edges of said mounting clips in said mounting position;

aligning said trim member on said mounting clips with said indented portions vertically aligned with said locating edges; and sliding said trim member upwardly on said mounting clips until said indented portions pass over said locating edges for detented engagement therewith at said mounting position.

2. The method as recited in claim 1 including:

separating each of said mounting clips above said barbs into a lower section and an upper section;

providing a second straight line on said peripheral surface;

aligning said upper sections with said second straight line; and separately attaching said upper sections to said peripheral surface.

* * * * *